US006055897A

United States Patent [19]

Mysliwiec

[11] Patent Number: 6,055,897

[45] Date of Patent: May 2, 2000

[54] DIE CUTTING INSERT FOR A ROTARY DIE CUTTER AND THE DIE ITSELF

[75] Inventor: Stefan Alojzy Mysliwiec, Kaukauna, Wis.

[73] Assignee: Kimberly-Clark Worldwide, Inc., Neenah, Wis.

[21] Appl. No.: 08/965,580

[22] Filed: Nov. 6, 1997

Related U.S. Application Data

[63] Continuation of application No. 08/667,578, Jun. 21, 1996, abandoned.

[51] Int. Cl.[7] ..... B26D 1/56

[52] U.S. Cl. ..... 83/698.41; 83/698.41; 83/346; 83/128

[58] Field of Search ..... 76/107.8; 83/698.41, 83/698.42, 347, 128, 698.51, 698.61, 698.21, 669, 123, 332, 333, 341, 346, 659

[56] References Cited

U.S. PATENT DOCUMENTS

| | | | |
|---|---|---|---|
| Re. 17,892 | 12/1930 | Wood | 83/659 X |
| 623,862 | 4/1899 | Armstrong | 83/128 |
| 1,044,931 | 11/1912 | Simmons | 83/117 |
| 1,363,526 | 12/1920 | Malm | 83/117 |
| 1,738,271 | 12/1929 | Andrews | 493/354 |
| 2,113,843 | 4/1938 | Kavle | 83/117 |

(List continued on next page.)

FOREIGN PATENT DOCUMENTS

| | | | |
|---|---|---|---|
| 546829 | 4/1956 | Belgium . | |
| 0297324 | 1/1989 | European Pat. Off. . | |
| 0391299 | 10/1990 | European Pat. Off. . | |
| 0525327 | 2/1993 | European Pat. Off. . | |
| 0670153 | 9/1995 | European Pat. Off. . | |
| 1420429 | 9/1964 | France . | |
| 1572994 | 7/1969 | France . | |
| 402216 | 9/1924 | Germany | 83/128 |
| 1436912 | 3/1969 | Germany . | |
| 137666 | 3/1960 | U.S.S.R. . | |
| 16735 | of 1915 | United Kingdom . | |
| 1442308 | 7/1976 | United Kingdom . | |
| 2024081 | 1/1980 | United Kingdom . | |
| 9102622 | 3/1991 | WIPO . | |
| 9219451 | 11/1992 | WIPO . | |

OTHER PUBLICATIONS

Patent Cooperation Treaty Search Report from the International Search Authority, International Application No. PCT/US 96/20709 dated Jun. 2, 1997.

Patent Cooperation Treaty Search Report from the International Search Authority, International Application No. PCT/US 96/20711 dated Apr. 22, 1997.

*Primary Examiner*—Rinaldi I. Rada
*Assistant Examiner*—Boyer Ashley
*Attorney, Agent, or Firm*—Thomas J. Connelly; Thomas M. Parker; Douglas G. Glantz

[57] ABSTRACT

A die cutting insert for a rotary die cutter is disclosed as well as the die itself. The insert includes a base formed on a predetermined radius. The base has first and second spaced apart ends and first and second oppositely aligned surfaces. A knife is formed about the periphery of the first surface. The knife has a cutting edge and first and second side walls. The cutting edge has a width of less than about 0.005 inches (0.127 mm). In addition, the first side wall is aligned approximately perpendicular to the cutting edge while the second side wall is aligned at an angle of at least about 15° relative to the cutting edge. The insert also includes a mechanism for removably attaching it to a die shaft. The mechanism includes at least one aperture formed adjacent to each of the first and second ends. The apertures extend completely through the base and each is sized to receive a threaded bolt. The threaded bolts can be torqued to a predetermined value to secure the insert to the die shaft. The rotary die cutter includes a die shaft having one or more replaceable and/or interchangeable die cutting inserts mounted thereto and is aligned to cooperate with a rotatable anvil roll. The die shaft and anvil roll are arranged to form a nip therebetween. Material which is to be cut can pass through the nip and will be cut into the desired shape of the die cutting inserts.

19 Claims, 2 Drawing Sheets

U.S. PATENT DOCUMENTS

| | | | |
|---|---|---|---|
| 2,381,955 | 8/1945 | Hoffman et al. | 164/28 |
| 2,525,987 | 10/1950 | Willamson | 83/117 |
| 3,106,121 | 10/1963 | Novick | 83/152 |
| 3,170,358 | 2/1965 | Martin | 83/673 |
| 3,488,778 | 1/1970 | Goujon et al. | 2/224 |
| 3,508,458 | 4/1970 | Cunningham | 83/9 |
| 3,526,163 | 9/1970 | Lowery | 83/27 |
| 3,552,244 | 1/1971 | Smith, Jr. | 83/116 |
| 3,663,962 | 5/1972 | Burger | 2/224 A |
| 3,744,384 | 7/1973 | Jarritt et al. | 93/58.2 R |
| 3,792,637 | 2/1974 | Saunders | 83/673 |
| 3,823,633 | 7/1974 | Ross | 83/698.41 X |
| 3,881,490 | 5/1975 | Whitehead et al. | 128/287 |
| 4,289,166 | 9/1981 | Haines | 137/846 |
| 4,412,467 | 11/1983 | DeSanto | 83/346 |
| 4,499,802 | 2/1985 | Simpson | 83/117 |
| 4,589,876 | 5/1986 | Van Tilburg | 604/385 R |
| 4,670,960 | 6/1987 | Provost | 29/415 |
| 4,862,574 | 9/1989 | Seidy | 29/415 |
| 5,048,389 | 9/1991 | Cook et al. | 162/109 |
| 5,086,683 | 2/1992 | Steidinger | 83/346 X |
| 5,111,725 | 5/1992 | Simpson et al. | 83/117 |
| 5,399,412 | 3/1995 | Sudall et al. | 428/153 |
| 5,452,634 | 9/1995 | Wilson | 83/99 |
| 5,826,475 | 10/1998 | Mysliwiec | 83/346 X |

DIE CUTTING INSERT FOR A ROTARY DIE CUTTER AND THE DIE ITSELF

This application is a continuation of application Ser. No. 08/667,578, filed Jun. 21, 1996, now abandoned.

FIELD OF THE INVENTION

This invention relates to a die cutting insert for a rotary die cutter and the die itself. More specifically, this invention relates to a replaceable and/or interchangeable die cutting insert for a rotary die which can be used to cut absorbent articles from a web of material.

BACKGROUND OF THE INVENTION

A rotary die cutter includes a rotatable anvil roll which cooperates with a rotatable knife shaft assembly. The knife shaft assembly has an outer circumference with at least one die cutter associated therewith. The knife shaft assembly cooperates with the anvil roll to form a nip through which a web of material can pass. As a web of material passes between the nip, the die cutter will cut the material into a predetermined shape.

Since the nip between the anvil roll and the knife shaft assembly is very small, it is necessary that the anvil roll and the knife shaft assembly be manufactured to very close tolerances. Because of the close tolerances, most rotary die cutters utilize a solid die shaft having the die cutters integrally formed thereon. When replaceable die cutting inserts have been mounted onto the circumference of a rotatable die shaft, it has been found that it becomes difficult to maintain the required close tolerances. In addition, it is difficult to attach the die cutting inserts without also introducing additional forces which can cause the inserts to flex under load. Up until now, in order to assure that the nip dimension remains constant, it was necessary to regrind the die cutting inserts after they were mounted on the knife shaft assembly to assure that the correct nip dimension would be present. This was particularly necessary when two or more die cutting inserts were mounted about the outer periphery of a die shaft.

Rotary die cutters are used in many different industries to cut many different types of material. For example, rotary die cutters can be employed to cut paper, cardboard, plastic, laminates formed of two or more layers, absorbent materials such as wood pulp fluff, webs formed from natural or synthetic fibers, cellulose fluff, tissue, cotton, rayon and various other types of woven and nonwoven materials. Rotary die cutters are particularly useful in cutting a plurality of layers of different material which have been assembled to form an absorbent article such as a sanitary napkin or a pantiliner. Such products are normally constructed, from top to bottom, of a liquid-permeable cover sheet, one or more absorbent layers, a liquid-impermeable baffle, a layer of garment attachment adhesive and a removable peel strip. The various layers are normally bonded together by a construction adhesive and the article usually has a total thickness of between about 0.1 (2.5 mm) inches to about 1.0 inch (25.4 mm).

Now a replaceable and/or interchangeable die cutting insert for a rotary die cutter has been invented along with the die itself. Each replaceable and/or interchangeable die cutting insert has a unique configuration and includes mounting means for properly securing it to the outer circumference of a knife shaft assembly.

SUMMARY OF THE INVENTION

Briefly, this invention relates to a replaceable and/or interchangeable die cutting insert for a rotary die cutter and the die itself. The insert includes an arcuately-shaped base formed on a pre-determined radius. The base has first and second spaced apart ends and first and second oppositely aligned surfaces. A continuous knife is integrally formed about the outer periphery of the first surface. The knife has a cutting edge and first and second side walls. The knife edge has a thickness of less than about 0.005 inches and the first side wall is aligned approximately perpendicular to the cutting edge. The second side wall is aligned at an angle of at least about 15° relative to the cutting edge. The die cutting insert also includes a mechanism for removably attaching it to a die cutting shaft. The mechanism can include at least one aperture formed adjacent to each end of the base. The apertures extend completely through the base and are designed to receive threaded bolts. The bolts are selected and sized to mate with the apertures and secure the base to the die cutting shaft.

The general object of this invention is to provide a replaceable and/or interchangeable die cutting insert for a knife shaft assembly. A more specific object of this invention is to provide a rotary die cutter having a rotatable anvil and a rotatable knife shaft assembly with one or more replaceable die cutting inserts mounted to the outer circumference of a die shaft.

Another object of this invention is to provide a knife shaft assembly having replaceable and/or interchangeable die cutting insert attached thereto which can be removed without requiring the inserts to be reground in order to obtain the right clearance nip between the anvil roll and the knife shaft assembly.

A further object of this invention is to provide a replaceable and/or interchangeable die cutting insert which can quickly and easily be removed and/or attached to a die shaft.

Still another object of this invention is to provide a replaceable and/or interchangeable die cutting insert which can easily be properly secured to a die shaft at a predetermined torque value.

Still further, an object of this invention is to provide a rotary die cutter having a rotatable anvil roll mating with a rotatable knife shaft assembly to form a nip therebetween and having one or more replaceable and/or interchangeable die cutting inserts mounted about its outer circumference of the knife shaft.

Other objects and advantages of the present invention will become more apparent to those skilled in the art in view of the following description and the accompanying drawings.

DETAILED DESCRIPTION OF THE PREFERRED EMBODIMENTS

Figure 1:
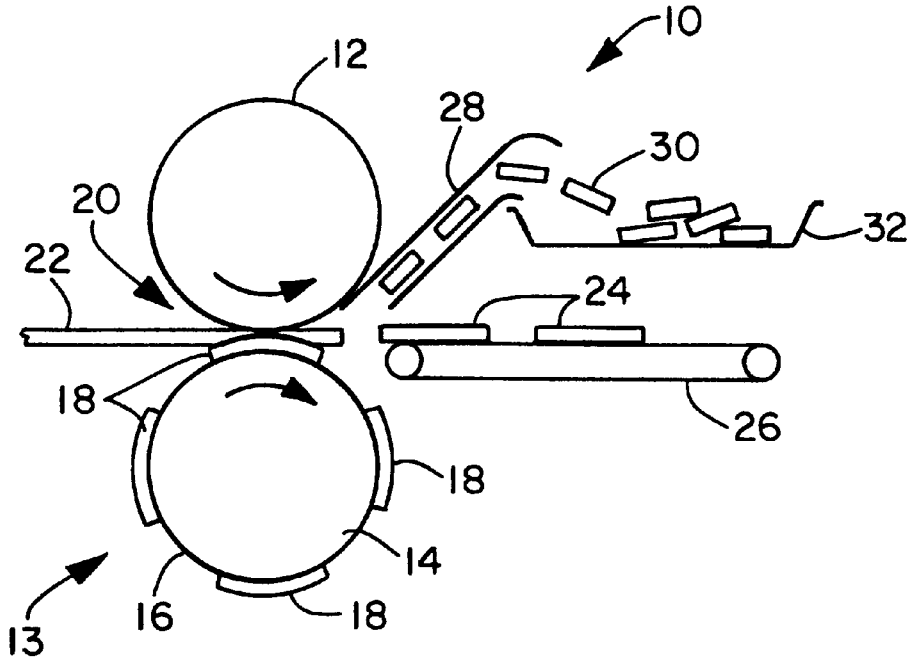
FIG. 1 is a schematic of a rotary die cutter showing a rotatable anvil roll cooperating with a rotatable knife shaft assembly to form a nip therebetween and having a web of material passing through the nip.

Referring to FIG. 1, a rotary die cutter 10 is shown which includes a rotatable anvil roll 12 cooperating with a rotatable knife shaft assembly 13. The anvil roll 12 can be constructed of a ferrous or non-ferrous metal and should have a smooth surface. The anvil roll 12 can be formed from a material which is compressible, such as neoprene rubber or from a non-compressible material, such as steel. For most applications, it is preferred that the anvil roll 12 be a metal roll.

The knife shaft assembly 13 includes a die shaft 14 with an outer circumference 16 and at least one replaceable and/or interchangeable die cutting insert 18 mounted onto the die shaft 14. By replaceable it is meant that the insert 18 can be unbolted and removed from the die shaft 14, cleaned, reground or machined in some fashion and then secured back onto the die shaft 14 in its original position. By interchangeable, it is meant that each of the die inserts 18 is capable of being mutually interchanged with any other insert 18. This interchangeability feature is very important because, up until now, it has been virtually impossible to produce replaceable and interchangeable inserts 18 for a rotary die cutter 10 while still maintaining the nip dimension between the anvil roll 12 and the knife shaft assembly 13.

The knife shaft assembly 13 can be constructed of a metal, for example steel, and should have an outer circumference machined to a very close tolerance. The die shaft 14 can have one or more, preferably several die cutting inserts 18 mounted to its outer circumference 16. As depicted in FIG. 1, there are four die cutting inserts 18 equally spaced about the outer circumference 16 of the die shaft 14. The anvil roll 12 and the knife shaft assembly 13 cooperate to form a nip 20 therebetween through which a web of material 22 can pass. As the anvil roll 12 and the knife shaft assembly 13 are rotated in opposite directions, the web of material 22 can pass through the nip 20 and be cut by the die cutting inserts 18 into individual articles 24. The articles 24 can be transported by conventional means, such as a conveyor 26, to a location where they can be stacked, packaged and later shipped. Any waste trim 30 from the rotary die cutter 10 can be directed away from the nip 20 by a conduit 28 using vacuum, air pressure, gravity or mechanical means. The waste trim 30 can then be collected in a hopper 32 for possible recycling or some other means of disposal.

Figure 2:
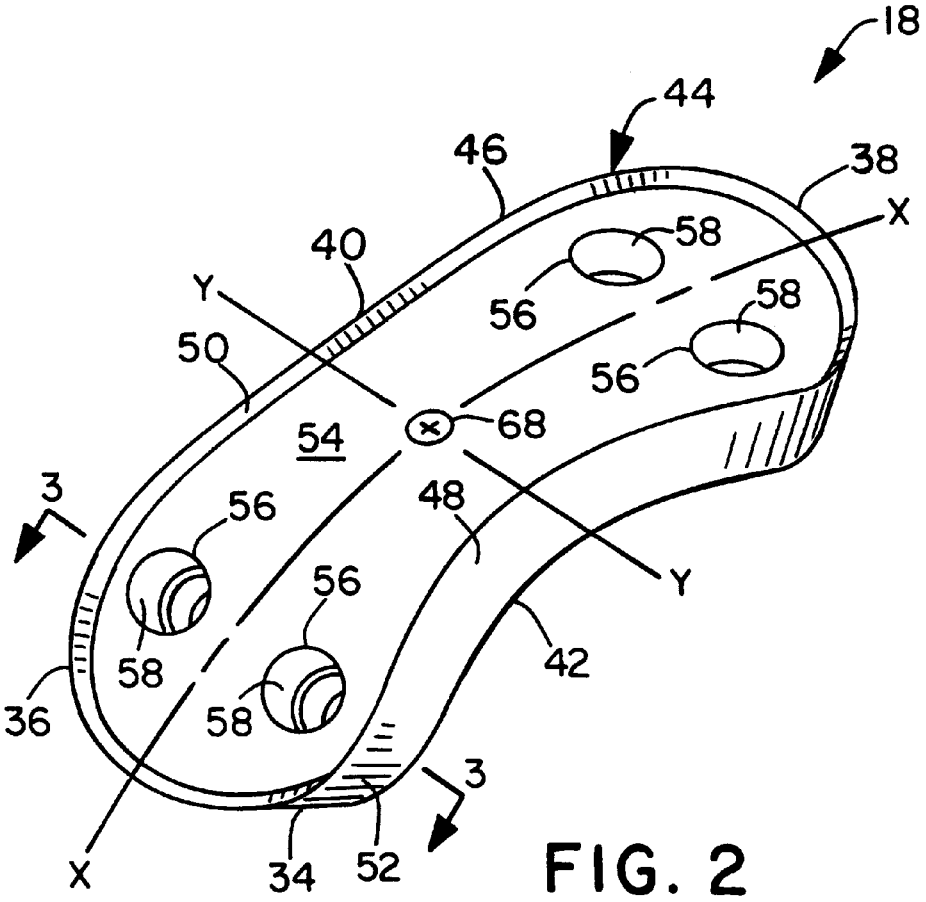
FIG. 2 is a perspective view of a replaceable and/or interchangeable die cutting insert.

Referring to FIG. 2, a replaceable and/or interchangeable die cutting insert 18 is shown before it is secured to the die shaft 14. The replaceable and/or interchangeable die cutting insert 18 has an arcuately-shaped base 34 formed on a predetermined radius. The base 34 has first and second spaced apart ends, 36 and 38 respectively, and first and second oppositely aligned surfaces, 40 and 42 respectively. The first surface 40 will face the anvil roll 12 when the inserts 18 are assembled onto the knife shaft assembly 13. The second surface 42 will be concave so as to match the outer circumference 16 of the die shaft 14 onto which the insert 18 is to be secured. It is common to machine the second surface 42 to have a tolerance of plus or minus 0.0001 inches (0.0025 mm) so as to facilitate a proper attachment between the die cutting insert 18 and the die shaft 14. If the second surface 42 is not machined to closely match the outer circumference 16 of the die shaft 14, then it is possible for additional compressive forces to develop as each insert 18 is secured to the die shaft 14. The presence of such compressive forces can alter the dimension of the nip 20, and this is undesirable.

Figure 3:
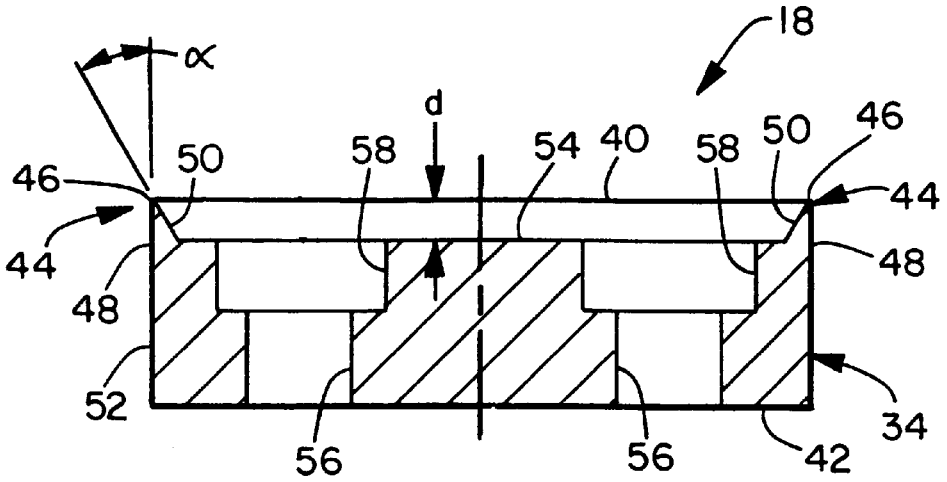
FIG. 3 is a cross-sectional view taken along line 3—3 of FIG. 2 showing the cutting edges and the mounting holes for attaching the insert to a die shaft.

Referring to FIGS. 2 and 3, the die cutting insert 18 is shown having a knife 44 which is integrally formed about the periphery of the first surface 40. Preferably, the knife 44 is a continuous element but could be serrated if desired. The knife 44 has a cutting edge 46 and first and second side walls, 48 and 50 respectively. The cutting edge 46 has a width of less than about 0.005 inches (0.127 mm). Preferably, the width of the cutting edge 46 is between about 0.0005 (0.0127 mm) to about 0.004 inches (0.102 mm), and most preferably, the width is between about 0.001 (0.025 mm) to about 0.002 inches (0.050 mm). The width of the cutting edge 46 is very important because if the thickness becomes too great, it will be more difficult to cleanly cut the material 22 passing through the nip 20. For example, instead of making a clean cut, the cutting edge 46 could compressed the material 22 and allow the material 22 to be torn or broken and thereby produce a ragged cut.

As shown in FIG. 3, the first side wall 48 is aligned approximately perpendicular to the cutting edge 46. In other words, the first side wall 48 is coextensively aligned with the outside periphery 52 of the base 34. Preferably, the first side wall 48 will be aligned perpendicular, that is at 90 degrees, to the cutting edge 46. The second side wall 50 is aligned in an angle of at least about 15° relative to the cutting edge 46. The second side wall 50 is located inward of the first side wall 48 and terminates at a third surface 54. The third surface 54 is located intermediate the first surface 40 and the second surface 42. The third surface 54 is spaced below the first surface 40 by a distance "d". The actual distance between the first surface 40 and the third surface 54 can vary but normally will be about equal to the thickness of the article 24 which is to be cut. For example, when cutting a compressible article having a total thickness of about 0.125 inches (3.175 mm), the distance of the third surface 54 below the first surface 40 can be between about 0.1 inches (2.54 mm) to about 0.125 inches ( 3.175 mm). The distance "d" also represents the height of the knife 44. The distance "d" can be affected by the type of material 22 which is being cut, the thickness of the material, whether the material is compressible, whether the material is formed from a single layer or from a plurality of layers, whether the layers are bonded together by an adhesive, as well as the particular characteristics of the material itself. For example, a thermoplastic film may react differently to be cut than a fibrous nonwoven web. It should also be noted that when cutting thinner materials, that the distance "d" could be less than the thickness of the material 22 because the cut may not have to extend as far through the material as with a thicker product. When cutting the material 22, it is not necessary that the cutting edge 46 actually contact the anvil roll 12. In fact, the life of the cutting die insert 18 can be extended when the cutting edge 46 does not physically contact the anvil roll 12.

The second side wall 50 is aligned at an angle $\alpha$ of at least about 15° relative to the cutting edge 46. Preferably, the angle $\alpha$ is between about 15° to about 50° relative to the cutting edge 46, and more preferably, the angle $\alpha$ is between about 15° to about 40° relative to the cutting edge 48. It is important that the second side wall 50 be angled relative to the cutting edge 46 at an angle $\alpha$ of at least about 15° because the design of the insert 18 leaves very little support for the knife 44. Since the first side wall 48 is approximately perpendicularly aligned to the cutting edge 46, all support provided to the knife 44 will have to come from the material present between the first side wall 48 and the second side wall 50. If the angle $\alpha$ is less than about 15°, there is a high probability that the cutting edge 46 will crack or chip as the material 22 is being cut because the forces acting on the cutting edge 46 can become very high.

Figure 4:
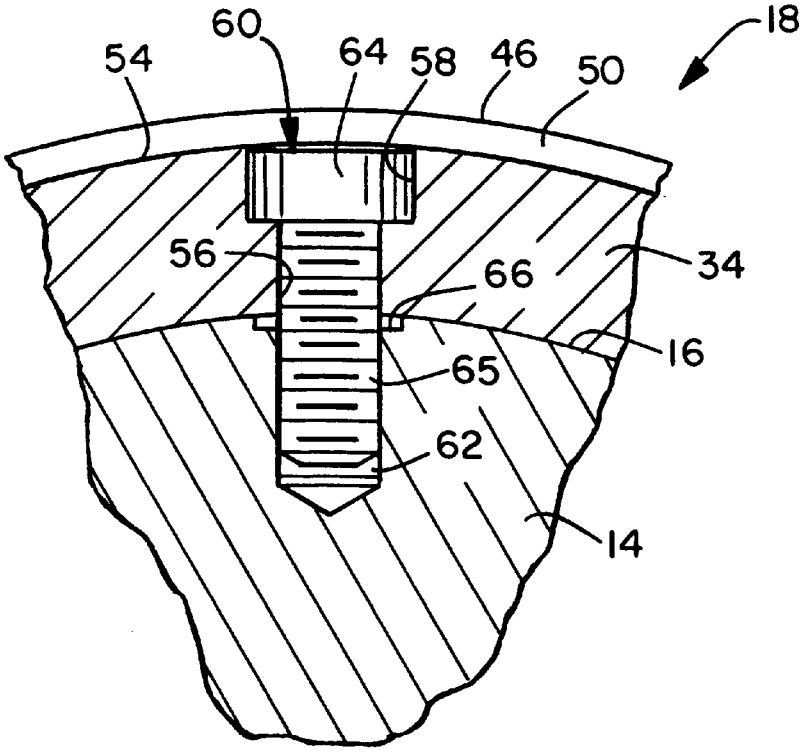
FIG. 4 is an exploded, cross-sectional view of a portion of the replaceable and/or interchangeable die cutting insert mounted to a portion of the outer circumference of the die shaft.

Referring now to FIGS. 3 and 4, the replaceable and/or interchangeable die cutting insert 18 further includes means for removably attaching the base 34 to at least a portion of the outer circumference 16 of the die shaft 14. It should be noted that the die shaft 14 can have one or more, and preferably a plurality of replaceable and/or interchangeable die cutting inserts 18 mounted about its outer circumference 16. The inserts 18 can be arranged so that they are equally spaced apart from one another or they can be arranged such that the outer periphery of one will contact the outer periphery of an adjacent insert 18. It is also possible to mount the inserts 18 on the outer circumference 16 of the die shaft 14 such that the inserts 18 are grouped around a portion of the outer circumference 16 while another portion of the outer circumference 16 is void of any inserts. The particular arrangement and the spacing of the inserts 18 will depend upon the type of material which is to be cut and the particular configuration of the articles which are to be cut.

One means for removably attaching the die cutting inserts 18 to the die shaft 14 includes forming at least one aperture 56 adjacent to each of the first and second ends, 36 and 38 respectively. Preferably, a pair of apertures 56 are formed adjacent to each of the ends, 36 and 38 respectively, so as to permit each insert 18 to be correctly secured to the die shaft 14 without introducing unwanted forces into each insert 18. Each of the apertures 56 extends completely through the base 34 from the third surface 54 to the second surface 42. The apertures 56 are not threaded but do contain a counterbore 58 located adjacent to the third surface 54. Each counterbore 58 is sized and configured to receive the head of a machine bolt 60, see FIG. 4, which will attach the insert 18 to the die shaft 14.

Referring to FIG. 4, a threaded machine bolt 60 is shown positioned in one of the apertures 56. The bolt 60 is aligned with and threaded into a threaded bore or aperture 62 formed in the die shaft 14. The bolt 60 contains a head 64 and a threaded shank 65. The head 64 is larger than the threaded shank 65 and is designed to seat in the counterbore 58 when the insert 18 is mounted onto the die shaft 14. When assembled, the head 64 will be flush with the third surface 54. Each of the machine bolts 60 can have a predetermined thread pitch. In addition, the length of the threads and the number of threads per inch can vary depending upon one's application. The size and style of the bolts 60 can be selected depending upon the size and configuration of the replaceable and/or interchangeable die cutting insert 18. It should be noted that it is desirable to tighten the bolts 60 to a relatively high torque setting, for example between about 100 pounds per square inch (psi) to about 1000 psi. Preferably, each bolt 60 is tightened to a torque setting of between about 200 psi to about 500 psi, and more preferably, between about 400 psi to about 500 psi. To facilitate the torquing of the bolts 60, it is recommended that a fine thread be used instead of a coarse thread. One bolt size which works well in mounting an insert measuring about six inches (152.4 mm) in length, about two inches (50.8 mm) in width and about 0.75 inches (19.05 mm) in depth to a die shaft 14 is a bolt 60 having the following diameter (inches) and thread 0.3125-24 UAF. It is also advantageous to drill and tap the threaded bore 62 to a depth which is greater than the threaded length of the bolt shank 65 so that the bolt 60 will not bottom-out in the threaded bore 62. This difference in length will allow the bolt 60 to be properly torqued during assembly.

In order to properly secure the replaceable and/or interchangeable die cutting inserts 18 to the die shaft 14, the bolts 60 should be sized and configured to mate with each pair of the coaxially aligned apertures 56 and 62. It should be noted that when each of the die cutting inserts 18 contains a single aperture 56 formed adjacent to each end, 36 and 38 respectively, that only two threaded bolts 60 will be required to secure each insert 18 to the die shaft 14. However, when each of the die cutting inserts 18 contains two apertures 56 formed adjacent to each end, 36 and 38 respectively, four threaded bolts 60 will be required to secure each insert 18 to the die shaft 14.

Referring again to FIG. 4, one of the threaded bores 62 is shown. It should be realized that there will be a plurality of threaded bores 62, one for each of the corresponding apertures 56 formed in each of the inserts 18. It is possible to arrange the threaded bores 62 in the die shaft 14 such that various sizes of inserts 18 can be assembled onto the die shaft 14 at a later time. By forming more threaded bores 16 than needed and arranging them at different locations about the outer circumference 16 of the die shaft 14, one can use a single die shaft 14 to accommodate two or more different style of die cutting inserts 18.

It has also been found to be extremely advantageous to form a counterbore 66 at the open end of each of the threaded bores 62. Each counterbore 66 begins at the outer circumference 16 of the die shaft 14 and has a depth of at least about 0.05 inches (1.27 mm). Preferably, the depth will range from about 0.1 inches (2.5 mm) to about 0.2 inches (5.0 mm), and more preferably, the depth will range between about 0.1 inches (2.5 mm) and about 0.15 inches (3.81 mm). A depth of about 0.125 inches (3.175 mm) works well when the threaded bores 62 have a diameter of about 0.3125 inches (7.9375 mm) or greater. The presence of the counterbores 66 is important for they function to relieve compressive stresses in the metal from which the die shaft 14 is constructed. Such force can occur as the replaceable and/or interchangeable die cutting inserts 18 are secured to the die shaft 14. It has been found that as a machine bolt 60 is threaded into the threaded bore 62 and then torqued to a relatively high inch pound value, that the metal forming the die shaft 14, on a microscopic scale, can actually buckle or deform as the die shaft 14 is drawn up against the insert 18. By forming the counterbore 66 at the open end of the threaded bore 62, one can minimize the amount of compressive stresses and forces which are developed.

Referring again to FIG. 2, the insert 18 can also contains a pin hole 68 formed at the intersection of the central longitudinal axis X—X and the central transverse axis Y—Y. The pin hole 68 is designed to be coaxially aligned with a hole or bore formed in the die shaft 14 such that a pin can be inserted through the pin hole 68 and serve to physically align the insert 18 onto the die shaft 14. Once the insert is aligned and held in position by a pin (not shown), the bolts 60 can be threaded into the threaded bores 62. It should be noted that the pin hole 68 is an optional feature and is present only for convenience in mounting the insert 18 onto the die shaft 14.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A rotary die cutter comprising:

a) a die shaft having an outer circumference with at least two die shaft bores, each of said die shaft bores having a die shaft outer periphery counterbore coaxially formed in said die shaft and respectfully aligned with said die shaft bores, wherein said die shaft outer periphery counterbores are located at said outer circumference of said die shaft and wherein said die shaft outer periphery counterbore relieve stresses in said die shaft imposed by a die cutting insert mounted to said die shaft;

b) a die cutting insert having a die cutting insert outside periphery and a die cutting insert inside periphery, said die cutting insert having first and second spaced apart ends;

c) a knife formed about the outside periphery of said die cutting insert, said knife having a cutting edge and first and second side walls with said first and second sidewalls being aligned at an angle of at least 15 degrees relative to one another; and d) means for removably attaching said die cutting insert at said die cutting insert inside periphery to said die shaft at said outer circumference of said die shaft, said means including at least one die cutting insert aperture formed adjacent to each of said first and second ends and extending completely through said die cutting insert; and at least two threaded bolts sized to mate with said die cutting insert apertures and secure said die cutting insert to said die shaft bores formed in said die shaft.

2. The rotary die cutter of claim 1 wherein said first sidewall is coextensive with said outside periphery of said die cutting insert.

3. The rotary die cutter of claim 1 wherein said second sidewall is located inward of said first sidewall.

4. The rotary die cutter of claim 1 wherein said second sidewall terminates into a third surface.

5. The rotary die cutter of claim 4 wherein said third surface is spaced at least 0.127 mm below said die cutting insert outside periphery.

6. The rotary die cutter of claim 1 wherein said first and second sidewalls are aligned at an angle of between about 15 degrees to about 50 degrees relative to one another.

7. The rotary die cutter of claim 6 wherein said first and second sidewalls are aligned at an angle of between about 15 degrees to about 40 degrees relative to one another.

8. The rotary die cutter of claim 7 wherein each of said die shaft counterbores has a depth of from about 2.5 mm to about 5.0 mm.

9. The rotary die cutter of claim 8 wherein each of said die shaft counterbores has a depth of about 3.175 mm.

10. A rotary die cutter comprising:

a) a die shaft having an outer circumference with at least four die shaft bores, each of said die shaft bores having a die shaft outer periphery counterbore coaxially formed in said die shaft and respectfully aligned with said die shaft bores, wherein said die shaft outer periphery counterbores are located at said outer circumference of said die shaft and wherein said die shaft outer periphery counterbore relieve stresses in said die shaft imposed by a die cutting insert mounted to said die shaft;

b) an arcuately shaped die cutting insert having a die cutting insert outside periphery and a die cutting insert inside periphery, said die cutting insert having first and second spaced apart ends;

c) a continuous knife integrally formed about the outside periphery of said die cutting insert, said knife having a cutting edge and first and second side walls with said first and second sidewalls being aligned at an angle of at least 15 degrees relative to one another; and d) means for removably attaching said die cutting insert at said die cutting insert inside periphery to at least a portion of the outer circumference of said die shaft, said means including a pair of die cutting insert apertures formed adjacent to each of said first and second ends, all of said die cutting insert apertures extending completely through said die cutting insert; and said means further including four threaded bolts sized to mate with said die cutting insert apertures and secure said die cutting insert to said die shaft bores formed in said die shaft.

11. The rotary die cutter of claim 10 wherein said first sidewall is coextensive with said outside periphery of said die cutting insert.

12. The rotary die cutter of claim 10 wherein said second sidewall is located inward of said first sidewall.

13. The rotary die cutter of claim 10 wherein said die cutting insert has a third surface and said second sidewall terminates at said third surface.

14. The rotary die cutter of claim 13 wherein said die cutting insert has a second surface and said apertures extend from said third surface to said second surface.

15. A rotary die cutter comprising:

a) a rotatable anvil roll;

b) a rotatable die shaft having an outer circumference with at least two threaded die shaft bores, each of said threaded die shaft bores having a die shaft outer periphery counterbore coaxially formed in said die shaft and aligned with said threaded die shaft bores, wherein said die shaft outer periphery counterbores are located at said outer circumference of said die shaft and wherein said die shaft outer periphery counterbores relieve stresses in said die shaft imposed by a die cutting insert mounted to said die shaft, said die shaft having at least one replaceable die cutting insert mounted thereto, each of said die cutting inserts cooperating with said anvil roll to form a nip between said anvil roll and said die cutting insert, each of said die cutting inserts having an arcuately shaped base, said base having first and second spaced apart ends, a continuous knife integrally formed about the periphery of said base, said knife having a cutting edge and first and second side walls with said first and second sidewalls being aligned at an angle of at least 15 degrees relative to one another, and means for removably attaching said base to said die shaft, said means including at least one die cutting insert non-threaded aperture formed adjacent to each of said first and second ends, said die cutting insert non-threaded apertures extending completely through said base, and at least two threaded bolts sized to mate with said die cutting insert non-threaded apertures and secure said die cutting insert to said die shaft bores formed in said die shaft.

16. The rotary die cutter of claim 15, wherein each of said die shaft counterbores has a depth of at least 1.27 mm.

17. The rotary die cutter of claim 15, wherein each of said die shaft counterbores has a depth of from about 2.5 mm to about 5.0 mm.

18. The rotary die cutter of claim 17, wherein each of said die shaft counterbores has a depth of about 3.175 mm.

19. The rotary die cutter of claim 15, wherein said rotatable die shaft with said outer circumference includes at least four die shaft bores, each of said at least four die shaft bores having a die shaft outer periphery counterbore coaxially formed with said at least four die shaft bores, wherein said die shaft outer periphery counterbores having a depth of from about 2.5 mm to about 5.0 mm and are located at said outer circumference of said die shaft and wherein said die shaft outer periphery counterbores relieve stresses in said die shaft imposed by a die cutting insert mounted to said die shaft.

* * * * *